US007310410B2

(12) United States Patent
Sohal et al.

(10) Patent No.: US 7,310,410 B2
(45) Date of Patent: Dec. 18, 2007

(54) SINGLE-LEAF X-RAY COLLIMATOR

(75) Inventors: Ratanjit Singh Sohal, Ludhiana (IN); Piyush Vijay Deshpande, Pratap Nagar (IN)

(73) Assignee: General Electric Co., Schenectady, NY (US)

( * ) Notice: Subject to any disclaimer, the term of this patent is extended or adjusted under 35 U.S.C. 154(b) by 28 days.

(21) Appl. No.: 10/900,799

(22) Filed: Jul. 28, 2004

(65) Prior Publication Data

US 2006/0023842 A1 Feb. 2, 2006

(51) Int. Cl.
*G21K 1/04* (2006.01)

(52) U.S. Cl. ..... 378/150; 378/153

(58) Field of Classification Search ..... 378/147–153
See application file for complete search history.

(56) References Cited

U.S. PATENT DOCUMENTS 3,411,000 A * 11/1968 Schliephake et al. ..... 378/153
3,852,594 A * 12/1974 Paolini ..... 378/81
4,219,734 A * 8/1980 Chery ..... 378/24
4,236,072 A * 11/1980 Schinkel et al. ..... 378/83
4,419,764 A * 12/1983 Kinanen ..... 378/153
5,628,238 A * 5/1997 Elsworth ..... 92/161
5,912,541 A * 6/1999 Bigler et al. ..... 318/600
6,072,854 A * 6/2000 Kikuchi et al. ..... 378/73
6,757,355 B1 * 6/2004 Siochi ..... 378/65
2003/0099328 A1 * 5/2003 Jensen et al. ..... 378/198

* cited by examiner

*Primary Examiner*—Edward J. Glick
*Assistant Examiner*—John M Corbett
(74) *Attorney, Agent, or Firm*—Peter Vogel, Esq.; Michael G. Smith, Esq.; Ellis B. Ramirez, Esq.

(57) ABSTRACT

A single-leaf X-ray collimator comprises at least one collimating leaf member having at least one collimating aperture. The collimating leaf member is adapted to be configured to rotate about at least one of a vertical or horizontal plane. The collimator provides elliptical collimation and hence improved dosage efficiency.

20 Claims, 5 Drawing Sheets

SINGLE-LEAF X-RAY COLLIMATOR

BACKGROUND OF THE INVENTION

This invention relates generally to radiation collimators, and more particularly, to leaf-type X-ray collimators for use in diagnostic medical imaging.

X-ray collimators are used in medical imaging applications to limit the field of an X-ray beam to a shape and size just sufficient to expose the area requiring diagnosis in a patient's body, and prevent unnecessary exposure of the surrounding area to X-rays. In other terms, a collimator helps to minimize the X-ray exposure and maximize the efficiency of X-ray dosage, to obtain optimum amount of pictorial data for diagnosis.

Generally, X-ray collimators provide a reduction in the field of an X-ray beam, by collimating the X-ray beam either to a substantial rectangular shape, a circular shape or a combination thereof, depending upon the configuration of the leaves or blades that block the X-rays for field reduction.

A typical configuration of an X-ray collimator that provides a rectangular collimation, includes at least a pair of planar blade members constructed of an X-ray attenuating material and arranged along the path of X-rays, which when moved to closer proximity in mutually opposing directions, block the X-rays, and thereby reduce the field of X-ray to a substantially rectangular shape for focusing on the area of a patient's body requiring diagnosis. However, the rectangular field shape encompasses a fairly large area of X-ray exposure as against the useful area of image and therefore results in low dosage efficiency.

The dosage efficiency "$\acute{\eta}$" is given by the relation:

$$\acute{\eta}=\text{Useful area of Image/Emitted area in same plane}$$

A typical configuration of an X-ray collimator that provides a circular collimation includes a discrete set of discs constructed of an X-ray attenuating material and arranged in a circular fashion, along the path of X-rays. On actuation, the discs limit the field size of X-ray beam to variable diameters, thereby providing a discrete circular collimation, for focusing on an area of a patient's body, requiring diagnosis. Although the discrete circular field shape encompasses comparatively lesser area of X-ray exposure than the rectangular field shape, the drive mechanism for the discs is complicated in structure, and also there is no significant increase in the dosage efficiency.

Another known configuration of an X-ray collimator (also popularly used for collimating gamma radiation in nuclear medicine), that provides a circular collimation includes eight to sixteen leaves constructed of an X-ray attenuating material, and arranged in a "camera-iris" type configuration. On actuation, the leaves allow increase or decrease in diameter of the X-ray beam, thereby obtaining a fairly continuous circular collimation, for focusing on the area of a patient's body requiring diagnosis. Although this configuration provides an improved dosage efficiency and enables performing a nearly continuous circular (e.g. octagonal) collimation by limiting the field of X-rays to a substantially larger extent than the discrete collimation technique, the collimator is complicated in structure and also very expensive (although feasible for use in nuclear medicine due to high risks associated with gamma ray exposure) for use in an X-ray apparatus.

Yet another configuration of a circular collimator is disclosed in the European Patent Document EP 1 026 698 A2, published Oct. 8, 2000, applicant "Ein-Gal, Moshe", which provides a novel revolving collimator system that can shape a radiation beam emanating from a radiation source with a plurality of mutually alignable collimators and pre-collimators. The collimators and pre-collimators are mounted on a plurality of revolving plates preferably stacked along a common axis. A control system with servomotors selectively rotates any one of the collimator plates, thereby aligning a plurality of collimators to form a path for collimating a radiation beam. This collimator, collimates and pre-collimates radiation beams over a wide range of diameter apertures suitable for virtually any kind of radiotherapy treatment plan. Although this system enables collimating the radiation beam to circular shape with different diameters, the system is much more complex as it makes use of selective and independent control mechanisms for each one of the collimator plates.

Yet another known configuration of a circular collimator includes a slidable leaf member having a collimating aperture therewithin, wherein the degree of sliding is proportional to the projected area of image exposure. Although this configuration adopts a simple mechanism, and allows continuous circular collimation, the dosage efficiency is not apparently significant.

Although these known collimators provide either a circular collimation, rectangular collimation or a combination thereof, none of the collimators provide (i) a simple configuration (ii) improved dosage efficiency (iii) efficient collimation and (iv) a cost effective solution for collimating X-rays, in terms of risk associated with X-ray exposure vis a vis the effort of treatment.

BRIEF DESCRIPTION OF THE INVENTION

In an embodiment, a single-leaf X-ray collimator is provided. The single-leaf collimator comprises at least one collimating leaf member disposed along the path of X-rays. The collimating leaf member comprises at least one collimating aperture and is configured to rotate about at least one of a horizontal or a vertical plane, wherein leaf member collimates the X-ray beam to about an elliptical shape.

DETAILED DESCRIPTION OF THE INVENTION

Various embodiments of the present invention provide a single-leaf collimator for X-rays, especially for use in diagnostic medical imaging. However, the embodiments are not so limited, and may be implemented in connection with other systems such as, for example, for collimating gamma rays in nuclear devices, etc.

In various embodiments, a single-leaf collimator for X-rays is provided, wherein the collimator comprises at least one collimating leaf member configured to rotate about at least one of a horizontal or vertical plane wherein said leaf member produces a collimated X-ray beam of about a continuous elliptical shape.

Figure 1:
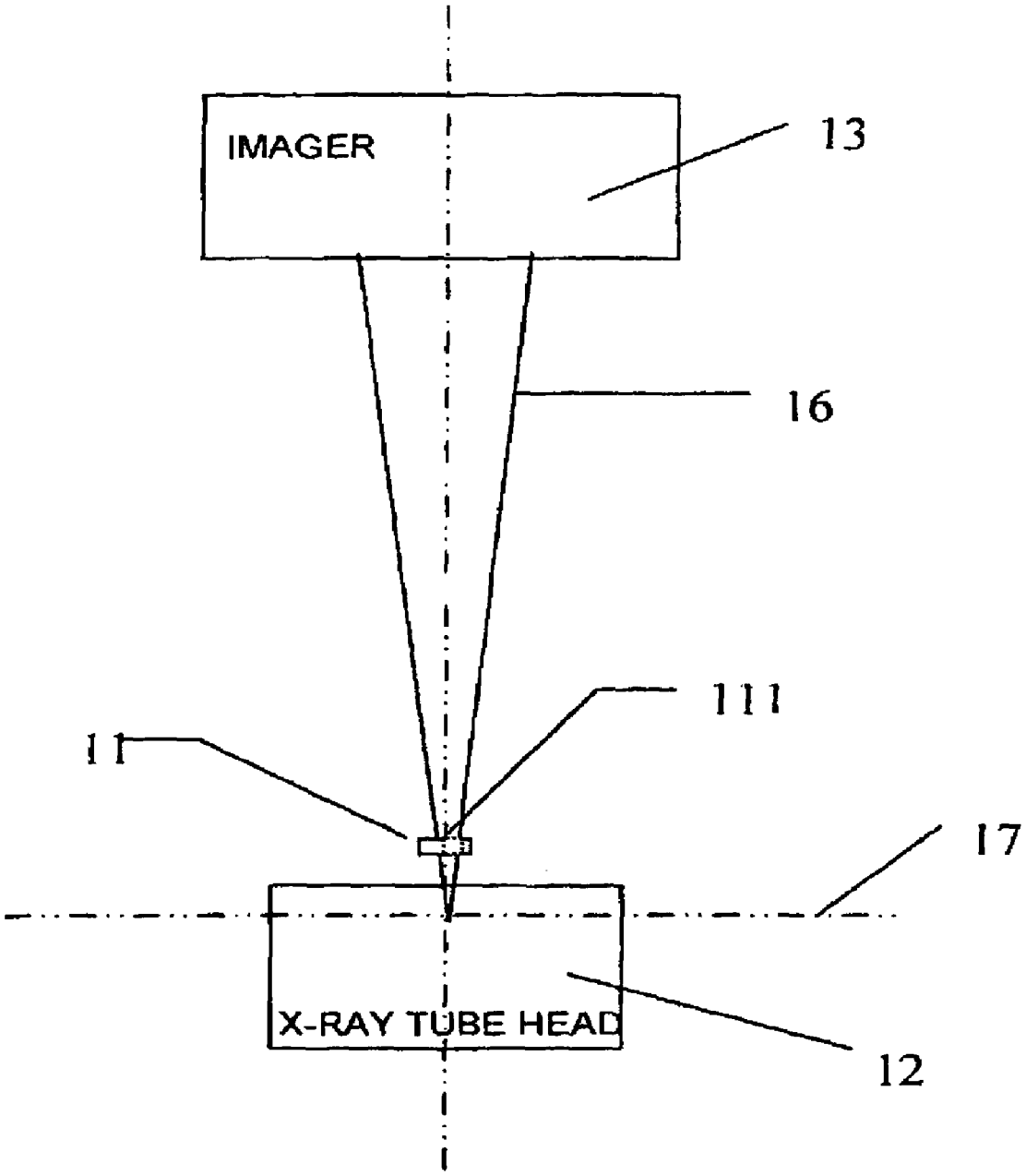
FIG. 1 shows a schematic plan view of the single-leaf collimator according to one embodiment of the present invention.

FIG. 1 shows a schematic plan view of a single-leaf collimator according to one embodiment of the present invention. The collimator includes at least one collimating leaf member 11 constructed of an X-ray attenuating material and disposed in-between an X-ray tube head 12 and an imager 13 as a part of an X-ray equipment such as, for example, a CT scanner, etc. At least one collimating aperture 111 (shown in FIG. 2), is provided in the collimating leaf member 11 for allowing an X-ray beam 16 emanating from a focal plane 17 of an X-ray tube head 12 to pass through the collimating leaf member 11 for collimation and to focus on a patient's body (not shown) positioned in front of the imager 13.

In an example, the collimating leaf member 11 is constructed of an X-ray attenuating material such as, copper, lead, tungsten, and an alloy thereof.

In another example, the collimating leaf member 11 is constructed of a plastic material impregnated with tungsten.

Figure 2:
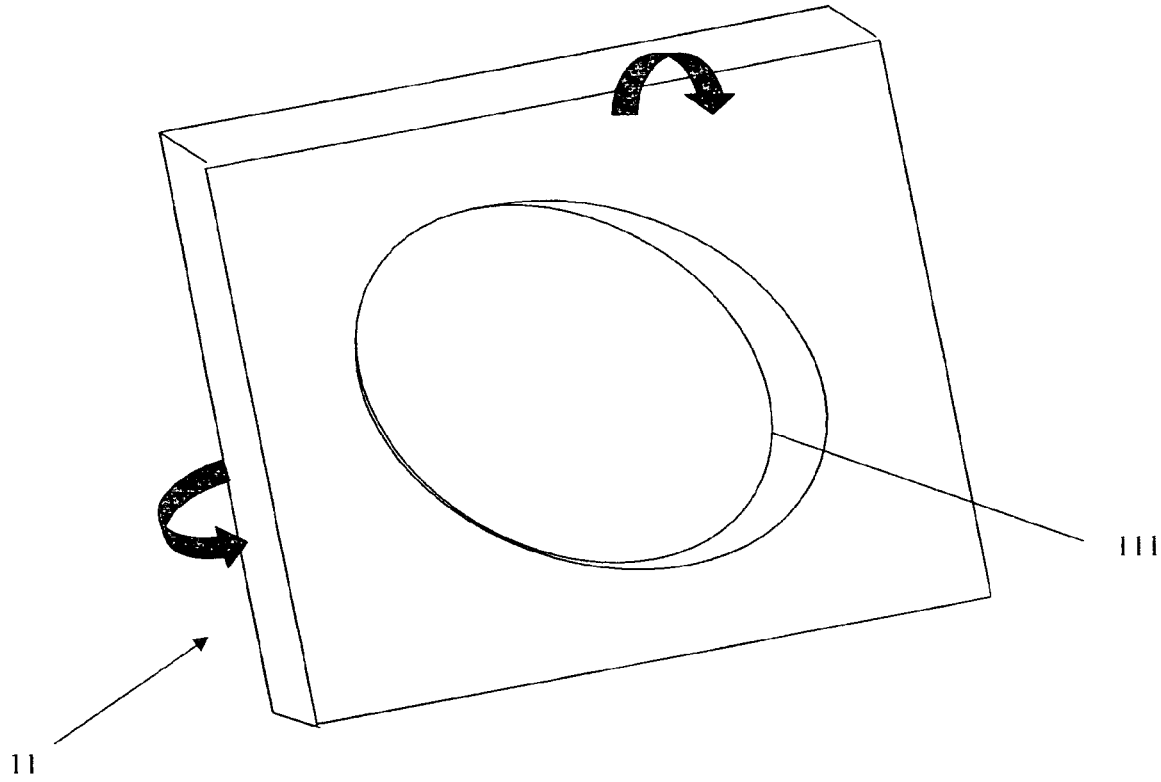
FIG. 2 shows the structure of collimating leaf member according to one embodiment of the present invention.

FIG. 2. In an embodiment, the collimating aperture 111 provided in the collimating leaf member comprises a substantial circular shape. The collimating leaf member 11 defines a plane and is configured to rotate (e.g. tilt) in at least one of a horizontal or vertical direction (e.g. along the directions indicated by arrows). Note that the rotation of the collimating leaf member 11 results in collimation of the X-ray beam 16 passing through the substantially circular aperture 111 to about continuous elliptical shape.

It should be noted that the size of the collimating leaf member 11 is substantially large to cover the entire field of the X-ray beam, in the tilted position and allow passage of X-ray beam only through the collimating aperture 111.

In an example, a drive means such as, for example, a DC Servo motor may be used to tilt the collimating leaf member 111 to a predetermined angle so as to produce an optimum collimated shape.

In another example, the drive means used for tilting the collimating leaf member may be a hydraulic or pneumatic actuator.

In an embodiment, the drive means and the collimating leaf member 11 are enclosed within a common housing (not shown). The housing is configured for securing detachedly to the tube head 12 using fasteners, or configured integral with the tube head 12.

Figure 3:
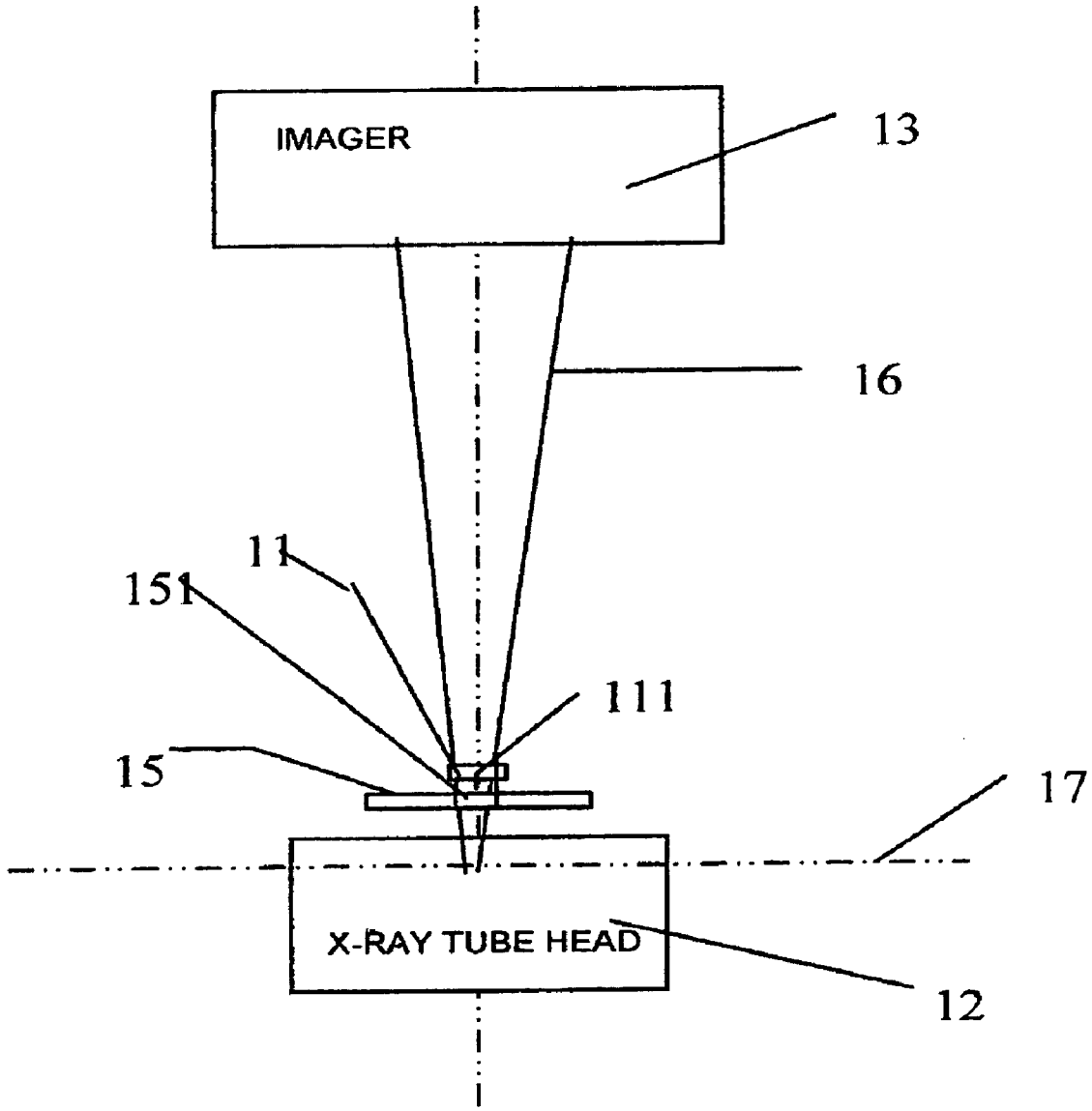
FIG. 3 shows a schematic plan view of the single-leaf collimator according to another embodiment of the present invention.

FIG. 3 shows another embodiment, wherein an auxiliary leaf member 15 (e.g, a dummy plate) constructed of an X-ray attenuating material is disposed in combination with the collimating leaf member 11. For example, the auxiliary leaf member 15 may be secured in close proximity to the collimating leaf member 11. The auxiliary leaf member 15 may include at least one auxiliary aperture 151 for passage of X-ray beam therethrough, to the collimating leaf member 11. The size of the auxiliary leaf member 15 is configured much larger than the collimating leaf member 11 to sufficiently block the X-rays at all tilted positions of the collimating leaf member 11.

For example, in a tilted position of the collimating leaf member 11, the projected width of the collimating leaf member 11 may become less than the width of the X-ray beam at that corresponding position, which may cause the X-ray beam to pass around the edges of the collimating leaf member 11 towards the patient's body. The purpose of the auxiliary leaf member 15 is to allow passage of X-ray beam through the aperture 111 of the collimating leaf member 11 for collimation and prevent passing over of X-ray beam around the edges of the collimating leaf member 11 to the patient's body, by sufficiently blocking the X-ray beam at all sliding positions of the collimating leaf member 11. A sufficient space is configured for rotation (tilting) of the collimating leaf member 11 without interference with the auxiliary leaf member 15.

It should be noted the auxiliary leaf member 15 is suitable for use in combination with the collimating leaf member 11 in equipments, in which mounting of a large tiltable collimating leaf member 11 sufficient enough to block the X-rays at all tilted positions is not possible or difficult.

In an example, the auxiliary leaf member 15 is made of X-ray attenuating materials such as, for example, lead, tungsten, copper or an alloy thereof.

In another example, the auxiliary leaf member is constructed of a plastic material impregnate with tungsten.

In an embodiment, a drive means for operating the collimating leaf member 111 is mounted on the auxiliary leaf member 15.

For example, a DC servomotor may be used for driving the collimating leaf member 11.

In other examples, a hydraulic or a pneumatic actuator may be used for driving the collimating leaf member 11.

Figure 4:
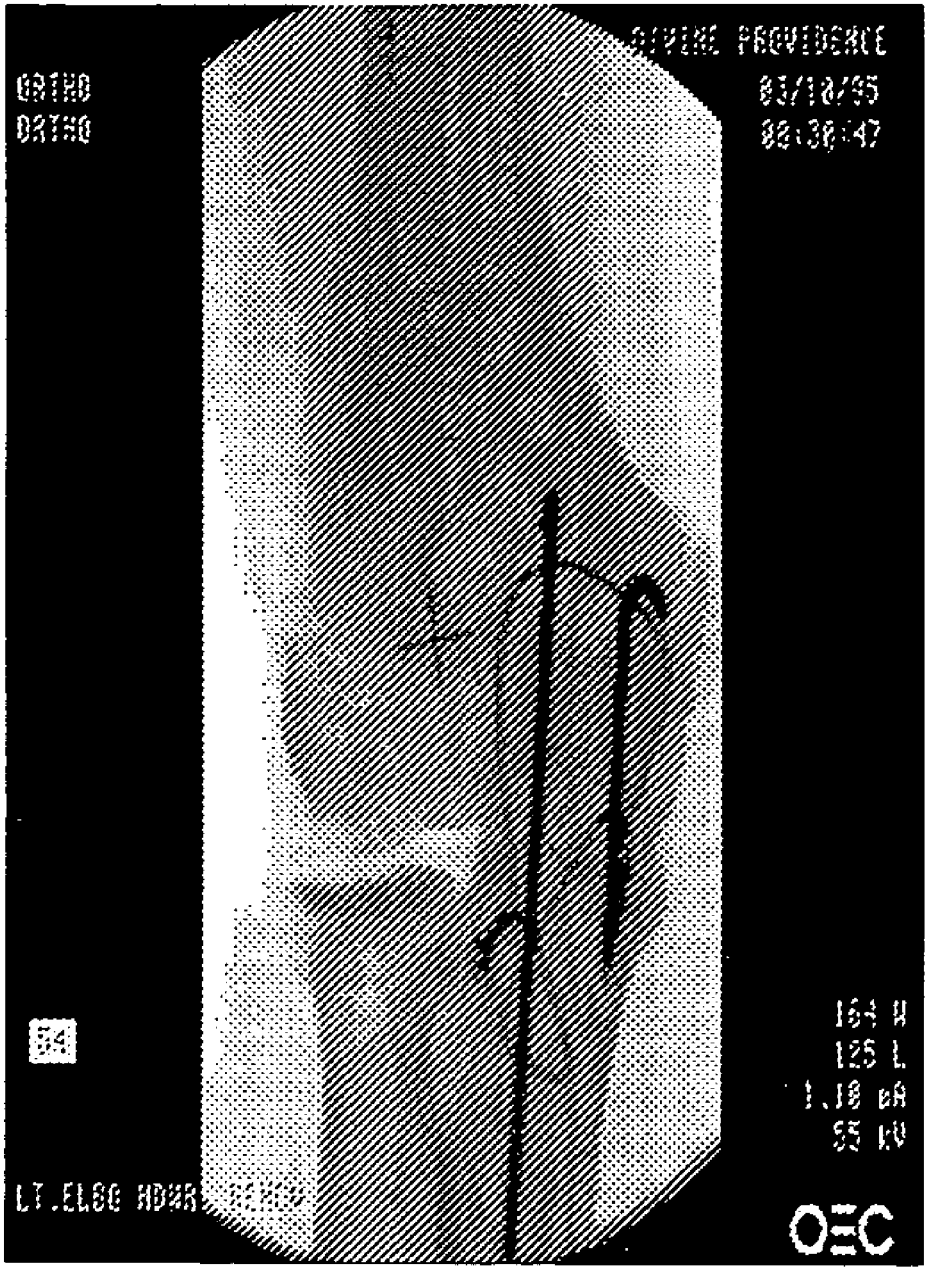
FIG. 4 (Prior Art)
FIG. 4 shows an X-ray image obtained by rectangular collimation according to prior art.
Figure 5:
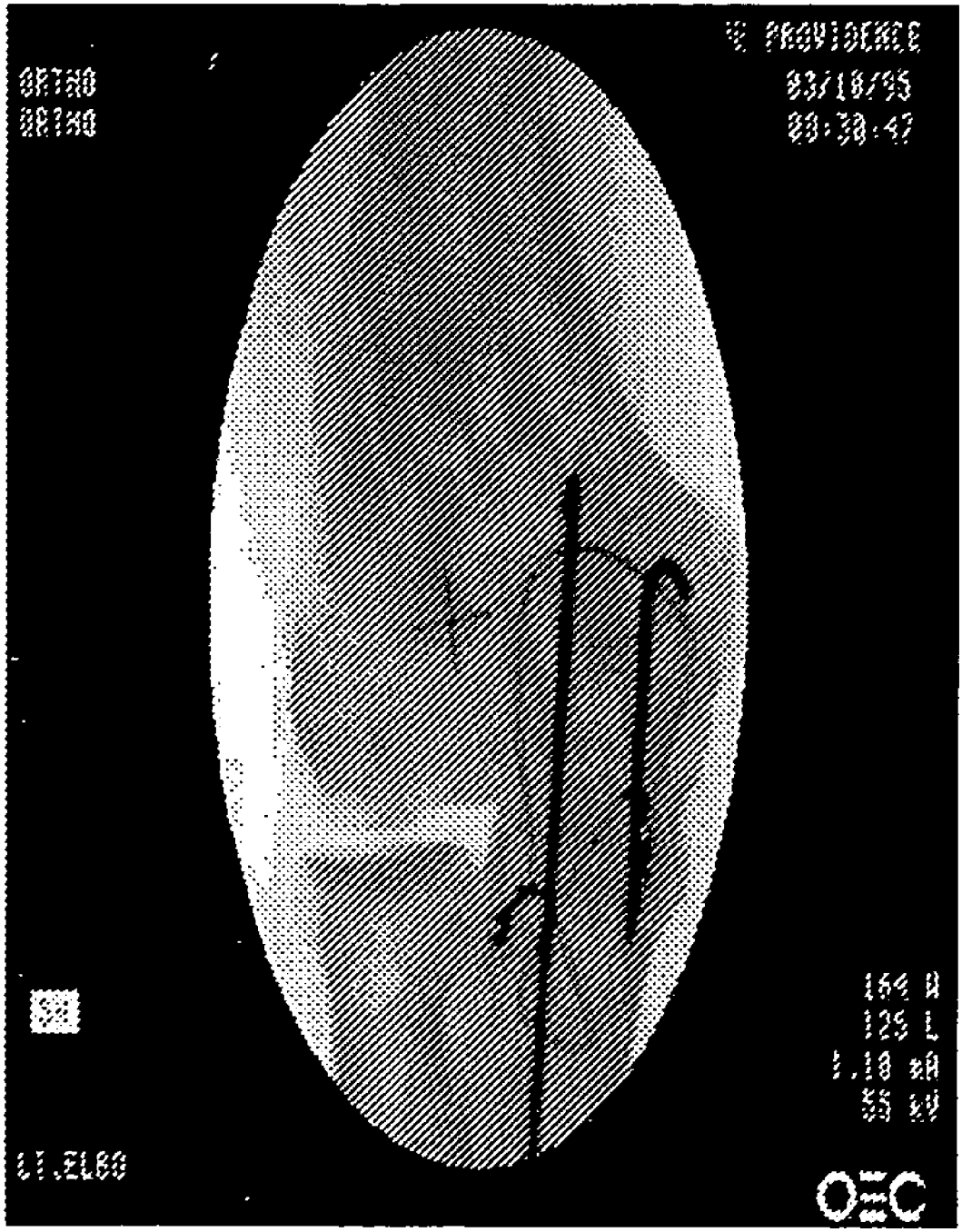
FIG. 5 shows an X-ray image obtained using the single-leaf collimator according to the present invention.

FIG. 4 shows an X-ray image obtained using an iris type collimator having eight blades in accordance with the prior art. The image obtained includes eight edges (octagonal shape) representing wastage of X-ray dose at the edges.

It should be noted that the dosage efficiency is a measure of the useful area of image against the area of X-ray exposure on the same plane. Accordingly, FIG. 4 shows an X-ray image obtained using single-leaf type collimator according to one embodiment of the present invention. The image obtained has an elliptical shape (without edges) encompassing a large useful area thereby resulting in an improved dosage and collimating efficiency. The dosage efficiency offered by the elliptical collimation is increased compared to a combination of rectangular and circular collimation as shown in FIG. 3.

Thus, various embodiments of the present invention provide a single-leaf X-ray collimator for use in diagnostic medical imaging.

While the invention has been described in terms of various specific embodiments, those skilled in the art will recognize that the invention can be practiced with modification for example, the collimator leaf member may be configured to slide in combination with tilting, provide various forms and methods of tilt and drive to the collimating leaf member. The collimating and auxiliary apertures may have various shapes for example, an elliptical shape, to obtain various shapes and sizes of collimated X-ray beam. However all such modifications are deemed to have been covered within the spirit and scope of the claims.

What is claimed is:

1. A single-leaf X-ray collimator comprising:

at least one planar collimating leaf member disposed along a path of X-rays, the planar collimating leaf member comprising at least one non-circular continuously elliptical collimating aperture therewithin, wherein the planar collimating leaf member is configured to rotate about at least one of a horizontal or vertical direction, and a driving means for tilting the at least one planar collimating leaf member relative to the path of X-rays in the least one of a horizontal or vertical direction.

2. The single-leaf collimator according to claim 1 wherein the collimating aperture provides improved collimating efficiency.

3. The single-leaf collimator according to claim 1 further comprises at least one auxiliary leaf member disposed along the path of X-rays.

4. The single-leaf collimator according to claim 3 wherein the auxiliary leaf member is provided in combination with the collimating leaf member.

5. The single-leaf collimator according to claim 3 wherein the collimating leaf member comprises a source side and an imager side for X-rays, wherein the auxiliary leaf member is disposed at the source side of the collimating leaf member.

6. The single-leaf collimator according to claim 3 wherein the auxiliary leaf member comprises a size that is predetermined to cover the entire field of X-rays at a distance from the source side.

7. The single-leaf collimator according to claim 3 wherein the collimating leaf member and the auxiliary leaf member are constructed of an X-ray attenuating material.

8. The single-leaf collimator according to claim 1 wherein the driving means further comprises a DC servomotor.

9. The single-leaf collimator according to claim 8 wherein the auxiliary leaf member further comprises the driving means.

10. A single-leaf collimator comprising:

a housing;

a collimating member operable to collimate a beam of X-rays within said housing; and a driving means operably coupled to the collimating member, wherein when the collimating member is rotated in at least one of a horizontal or vertical direction by the driving means, the X-ray beam is collimated to a non-circular continuously-elliptical shape.

11. The single-leaf collimator according to claim 10 further comprising an auxiliary leaf member in combination with the collimating member.

12. The single-leaf collimator according to claim 11 wherein the auxiliary leaf member is adapted for sliding along the path of X-rays, in combination with the collimating member.

13. The single-leaf collimator according to claim 11 wherein the auxiliary leaf member is configured to cover about entire field of X-rays.

14. The single-leaf collimator according to claim 11 wherein the auxiliary leaf member is configured to allow passage of X-rays therethrough to the collimating member.

15. The single-leaf collimator according to claim 14 wherein the collimating member and the auxiliary member are constructed of an X-ray attenuating material.

16. The single-leaf collimator according to claim 11 wherein the auxiliary leaf member further comprises the driving means.

17. The single-leaf collimator according to claim 11 wherein the auxiliary leaf member further comprises:

an auxiliary leaf member for collimating, the auxiliary leaf member being substantially large to cover an entire field of the X-ray beam, in a rotated position and allow passage of the X-ray beam only through an aperture of the collimating member.

18. The single-leaf collimator according to claim 10 wherein the collimating member comprises a source side and an imager side for X-rays, wherein the auxiliary leaf member is disposed at the source side of the collimating member.

19. The single-leaf collimator according to claim 10 wherein the driving means further comprises:

a hydraulic actuator.

20. The single-leaf collimator according to claim 10 wherein the driving means further comprises:

a DC Servo motor.

* * * * *